US012774867B1

(12) United States Patent
Obteshka et al.

(10) Patent No.: US 12,774,867 B1
(45) Date of Patent: Oct. 27, 2026

(54) COMPACT QUIVER FOR A BOW

(71) Applicant: Ravin Crossbows, LLC, Superior, WI (US)

(72) Inventors: Nicholas C. Obteshka, Springfield, OR (US); Kevin Casey, Rochester, NY (US)

(73) Assignee: Ravin Crossbows, LLC, Superior, WI (US)

( * ) Notice: Subject to any disclaimer, the term of this patent is extended or adjusted under 35 U.S.C. 154(b) by 96 days.

(21) Appl. No.: 18/392,912

(22) Filed: Dec. 21, 2023

Related U.S. Application Data

(60) Provisional application No. 63/434,768, filed on Dec. 22, 2022.

(51) Int. Cl.
*F41B 5/06* (2006.01)

(52) U.S. Cl.
CPC ..... *F41B 5/066* (2013.01)

(58) Field of Classification Search
CPC .. F41B 5/06; F41B 5/063; F41B 5/066; F41B 5/12; F41B 5/126
See application file for complete search history.

(56) References Cited

U.S. PATENT DOCUMENTS 6,330,881 B1 * 12/2001 Pippard ..... F41B 5/10 124/25.7
6,763,817 B2 * 7/2004 Nickell ..... F41B 5/123 124/25.5
7,367,331 B1 * 5/2008 Horinek ..... F41B 5/066 224/916
7,942,141 B1 * 5/2011 Love ..... F41B 5/066 224/916
8,714,147 B2 * 5/2014 Walk ..... F41B 5/066 224/916
8,839,772 B2 * 9/2014 Lee ..... F41B 5/066 224/916
8,899,221 B2 * 12/2014 Barnett ..... F41B 5/066 224/916
8,931,469 B2 * 1/2015 Kingsbury ..... F41B 5/066 124/88
9,372,045 B1 * 6/2016 Kempf ..... F41B 5/066
9,400,154 B2 * 7/2016 McPherson ..... F41B 5/148
9,494,399 B2 * 11/2016 Paschke ..... A45C 11/00
9,651,330 B1 * 5/2017 LoRocco ..... F41B 5/066
9,829,271 B2 * 11/2017 McPherson ..... F41B 5/14
11,796,277 B2 10/2023 Mcpherson
12,000,668 B2 6/2024 Mcpherson
12,000,669 B2 6/2024 Mcpherson et al.
2018/0027954 A1 * 2/2018 Schneider ..... F41C 33/06

* cited by examiner

*Primary Examiner* — Nicholas J. Weiss
(74) *Attorney, Agent, or Firm* — Foley & Lardner LLP

(57) ABSTRACT

Systems and apparatuses include a compact quiver assembly for a crossbow defining an envelope. The compact quiver assembly including a hood defining an interior cavity, a grabber received within the cover and structured to hold one or more arrows, and a cover moveable relative to the hood between an open position providing access to the grabber, and a closed position inhibiting access to the grabber. The compact quiver assembly is positioned substantially within the envelope of the crossbow.

19 Claims, 16 Drawing Sheets

COMPACT QUIVER FOR A BOW

CROSS REFERENCE TO RELATED PATENT APPLICATIONS

This application claims the benefit of and priority to U.S. Provisional Patent Application No. 63/434,768, entitled "COMPACT QUIVER FOR A BOW," filed on Dec. 22, 2022, the entire disclosure of which is hereby incorporated by reference herein.

BACKGROUND

The present disclosure relates generally to bows. More specifically, the present disclosure relates to compact quiver assemblies for crossbows.

SUMMARY

One embodiment relates to a compact quiver assembly for a crossbow defining an envelope. The compact quiver assembly includes a hood defining an interior cavity, a grabber received within the cover and structured to hold one or more arrows, and a cover moveable relative to the hood between an open position providing access to the grabber, and a closed position inhibiting access to the grabber. The compact quiver assembly is positioned substantially within the envelope of the crossbow.

Another embodiment relates to a compact quiver assembly for a crossbow defining an envelope. The compact quiver assembly includes a first magazine structured to hold a plurality of arrows, a second magazine structured to hold a plurality of arrows, and a mount coupled to both the first magazine and the second magazine, the mount defining a quick connection structured to engage the crossbow. The compact quiver assembly is positioned substantially within the envelope of the crossbow.

Another embodiment relates to a crossbow that includes a barrel rail defining a projectile axis, a cocking mechanism including a pump actuator, movable in an axial motion, parallel to the projectile axis to cock the crossbow, and a compact quiver assembly coupled to the barrel rail, the compact quiver assembly including: a hood defining an interior cavity, a grabber received within the cover and structured to hold one or more arrows, and a cover moveable relative to the hood between an open position providing access to the grabber, and a closed position inhibiting access to the grabber. The crossbow defines an envelope, and the compact quiver assembly is positioned wholly within the envelope of the crossbow.

Another embodiment relates to a compact quiver assembly that includes a hood defining an interior cavity, a grabber received within the hood and structured to hold one or more arrows, and a cover moveable relative to the hood between an open position providing access to the grabber, and a closed position inhibiting access to the grabber.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Figure 1:
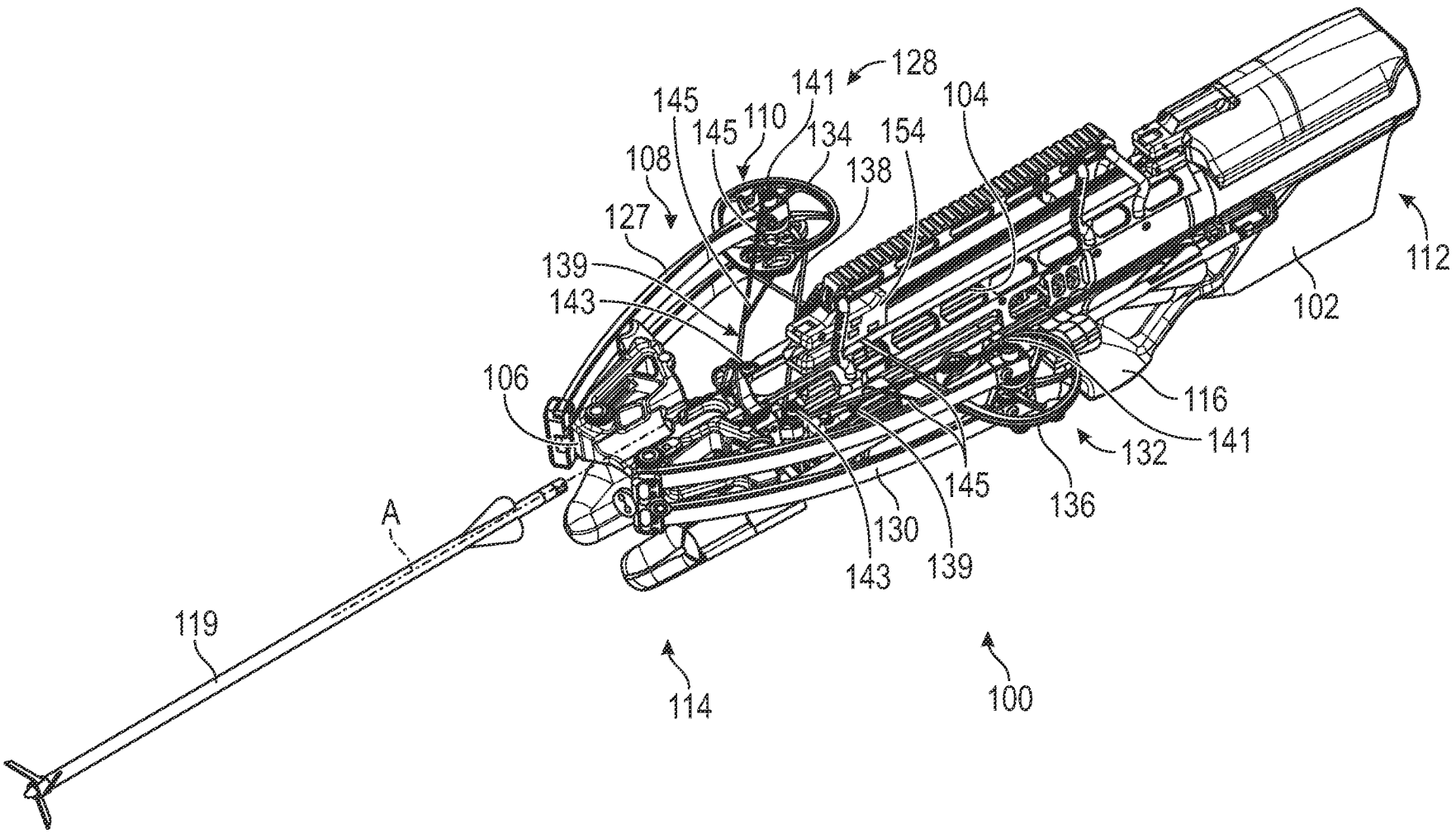
FIG. 1 is a perspective view of a crossbow, according to some embodiments.

Following below are more detailed descriptions of various concepts related to, and implementations of, methods, apparatuses, and systems for a compact quiver system for a bow. Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring to the figures generally, the various embodiments disclosed herein relate to a compact quiver assembly for a bow. In some embodiments, the bow is a vertical bow. In some embodiments, the bow is a crossbow. The compact quiver assembly includes one or more magazines sized to hold and enclose arrow broadheads. The compact quiver assembly is positioned tight to the bow or crossbow. In some embodiments, the bow or crossbow defines an envelope and the compact quiver assembly is physically contained within the envelope of the crossbow. Maintaining the compact quiver assembly and stored arrows within the envelop reduces the incidence of snagging or hanging up the stored arrows or a portion of the compact quiver assembly on a tree branch or other obstacle. In some embodiments, the compact quiver assembly includes two magazines. Each magazine includes a hood, an arrow grabber within the hood that engages arrows, and a cover moveable relative to the hood between an open position and a closed position. The compact quiver assembly can quickly detach from the crossbow. In some embodiments the compact quiver assembly includes a left magazine and a right magazine. In some embodiments, the left magazine and the right magazine are connected and are removable from the crossbow as a unit. In some embodiments, the left magazine and the right magazine are separate and are removable from the crossbow separately. In some embodiments, the compact quiver assembly mounts to a lower mounting rail (e.g., a Picatinny rail). The cover protects the broadheads of stored arrows, the shafts of the stored arrows at a primary point of impact, and the user's hand while the crossbow is in use. The arrow grabber is positioned within the hood so that in the event of a stored arrow inadvertently being removed from the grabber, the broadhead of the removed arrow is maintained within the hood and cover of the magazine rather than falling to ground. In some embodiments, each magazine holds two arrows. In some embodiments, each magazine holds one, or more than two arrows. In some embodiments, the cover is spring biased toward the closed position. In some embodiments, the hood is formed form a plastic and the grabber is formed of a rubber material to protect the stored broadheads and reduce noise. In some embodiments, the grabber holds the stored arrows such that the arrows extend to different forward distances and fletchings of the stored arrows do not contact one another. In some embodiments, the crossbow is a pump action crossbow that is cocked with a pumping mechanism. The compact quiver assembly is positioned so that the pumping mechanism can operate freely with the compact quiver assembly installed on the crossbow. In some embodiments, the crossbow is not a pump action crossbow and is cocked with a cranked cocking system, a drawstring cocking system, or another cocking system as desired. In some embodiments, the compact quiver assembly is used with a standard or vertical bow. In some embodiments, the compact quiver assembly is used with another archery product or projectile launcher as desired. In some embodiments, the compact quiver assembly also includes a nock-end grabber. In some embodiments, the cover is connected to the hood by a hinge and the cover is rotatable relative to the hood between the open position and the closed position. In some embodiments, the grabber defines arrow openings and the arrow openings angle downward and outward. The angle of the arrow openings helps with insertion and removal of arrows without interfering with the rest of the crossbow. In some embodiments, the compact quiver assembly includes a remote mount for install on a remote object (e.g., a blind, a tree stand, a stand, a tree, etc.) to allow removal of the compact quiver assembly from the crossbow and mounting on a remote object.

As shown in FIGS. 1-4 a crossbow 100 includes a stock 102, a barrel rail 104, a riser 106, a limb assembly 108, and a cam assembly 110. The barrel rail 104 is coupled between the stock 102 and the riser 106, with the stock 102 being arranged at a first or rear end 112 of the barrel rail 104 and the riser 106 being arranged at a second or front end 114 of the barrel rail 104. The stock 102 includes a grip 116 and a trigger 118 (see FIG. 3). During operation, a user may grasp the grip 116 and manipulate the trigger 118 (e.g., compress the trigger 118) to fire a projectile 119 from the crossbow 100.

The barrel rail 104 defines a projectile axis A (see FIG. 1) along which the projectile 119 can be arranged and fired. The riser 106 is coupled to the limb assembly 108 so that the limb assembly 108 can flex relative to the riser 106. For example, the limb assembly 108 includes a plurality of flexible limbs that each extend from the riser 106, in a direction back toward the rear end 112, to a free end. The free ends of the flexible limbs enable the flexible limbs to flex relative to the riser 106 and generate a firing force that is applied to a projectile as the crossbow 100 is fired. In some embodiments, the limb assembly 108 includes a first limb assembly 127 coupled to a first lateral side 128 (e.g., a right side) of the riser 106 and a second limb assembly 130 coupled to a second lateral side 132 (e.g., a left side) of the riser 106. In the illustrated embodiment, the first limb assembly 127 and the second limb assembly 130 both include two flexible limbs. In some embodiments, the first limb assembly 127 and the second limb assembly 130 both include more or less than two flexible limbs (e.g., one flexible limb, three flexible limbs, etc.).

The cam assembly 110 includes a first cam 134 (e.g., a right cam) and a second cam 136 (e.g., a left cam). The first cam 134 is rotatably coupled to the free ends of the flexible limbs in the first limb assembly 127, and the second cam 136 is rotatably coupled to the free ends of the flexible limbs in the second limb assembly 130. The cam assembly 110 is coupled to a drawstring 138 that is configured to move between an undrawn position (see, e.g., FIG. 1) and a drawn position where the drawstring 138 is displaced along the projectile axis A toward the stock 102 (i.e., toward the rear end 112 of the barrel rail 104). The cam assembly 110 is further coupled to one or more power cables 139. A first power cable is 139 engages with the first cam 134. A second power cable 139 engages with the second cam 136.

More particularly, the first power cable 139 engages with a power cable groove, journal, pulley, or other portion of the first cam 134. The first power cable 139 is routed from the first cam 134 to a first pulley 143 (e.g., an idler), and from the first pulley 143 toward the second limb assembly 130. The first pulley 143 is rotatably coupled to the barrel frame 104 or the riser 106. The first power cable 139 includes upper and lower portions 145 (e.g., upper and lower portions of the same cable 139) that are respectively coupled to a top and bottom region 141 of an axle about which the second cam 136 rotates. In other embodiments, the upper and lower portions 145 are coupled to one or more flexible limbs 124 to which the second cam 136 is coupled. Because the first power cable 139 is routed from the first cam 134 to the second cam 136, the first power cable 139 crosses over the projectile axis A. The second power cable 139 engages with a power cable groove, journal, pulley, or other portion of the second cam 136. The second power cable 139 is routed from the second cam 136 to a second pulley 143 (e.g., an idler), and from the second pulley 143 toward the first limb assembly 127. The pulley 143 is rotatably coupled to the barrel frame 104 or the riser 106. The second pulley 143 is rotatably coupled to the barrel frame 104 or the riser 106. The second power cable 139 includes upper and lower portions 145 (e.g., upper and lower portions of the same cable 139) that are respectively coupled to a top and bottom region 141 of an axle about which the first cam 134 rotates. In other embodiments, the upper and lower portions 145 are coupled to one or more flexible limbs 124 to which the first cam 134 is coupled. Because the second power cable 139 is routed from the second cam 136 to the first cam 134, the second power cable 139 crosses over the projectile axis A.

As the drawstring 138 is displaced from the undrawn position to the drawn position, the first cam 134 and the second cam 136 rotate relative to the free ends of the flexible limbs, and the flexible limbs flex relative to the riser 106. As the first cam 134 and the second cam 136 rotate, the first power cable 139 and the second power cable 139 are respectively wound on the first cam 134 and the second cam 136 (e.g., via the power cable journal or similar feature). The flexing of the flexible limbs loads the flexible limbs and generates a firing force on the drawstring 138. Once the drawstring 138 is in the drawn position, the user may selectively compress the trigger 118 to release the drawstring 138 and unload the flexible limbs. The drawstring 138 then travels back to the undrawn position and the unloading of the flexible limbs transfers the firing force to the projectile 119 notched to the drawstring 138, and fires the projectile 119 along the projectile axis A and outwardly from the front end 114 of the barrel rail 104.

Figure 3:
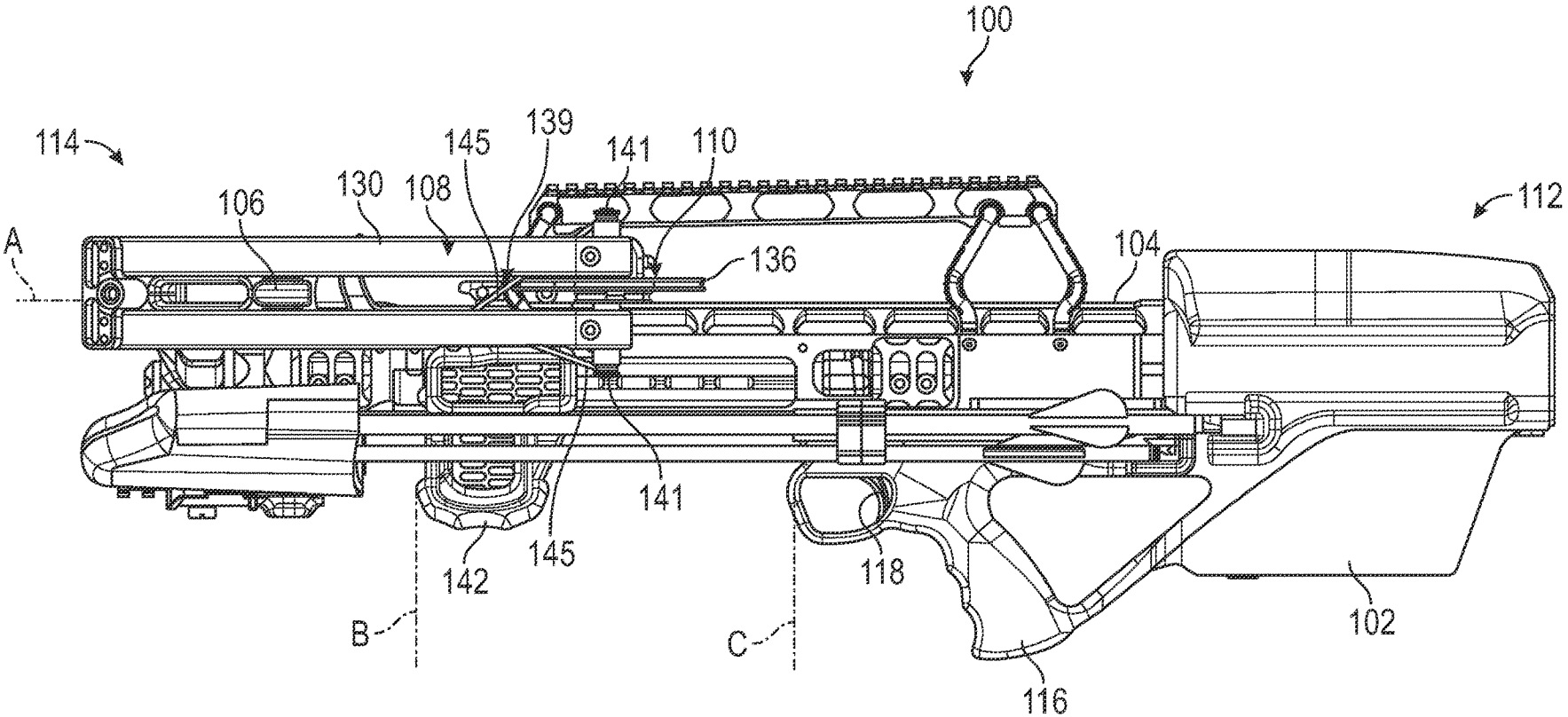
FIG. 3 is a left side view of the crossbow of FIG. 1.

As shown in FIG. 3, the crossbow 100 includes a pump handle 142 that translates between a forward position B and a rearward position C to cock the crossbow 100. In some embodiments, the pump handle 142 translates linearly in a direction parallel to the projectile axis A. In some embodiments, the pump handle 142 is connected to a reciprocating winding mechanism that retracts a string carrier 154 toward a retracted position to cock the bow when the pump handle 142 is moved between the forward position B and the rearward position C.

Figure 2:
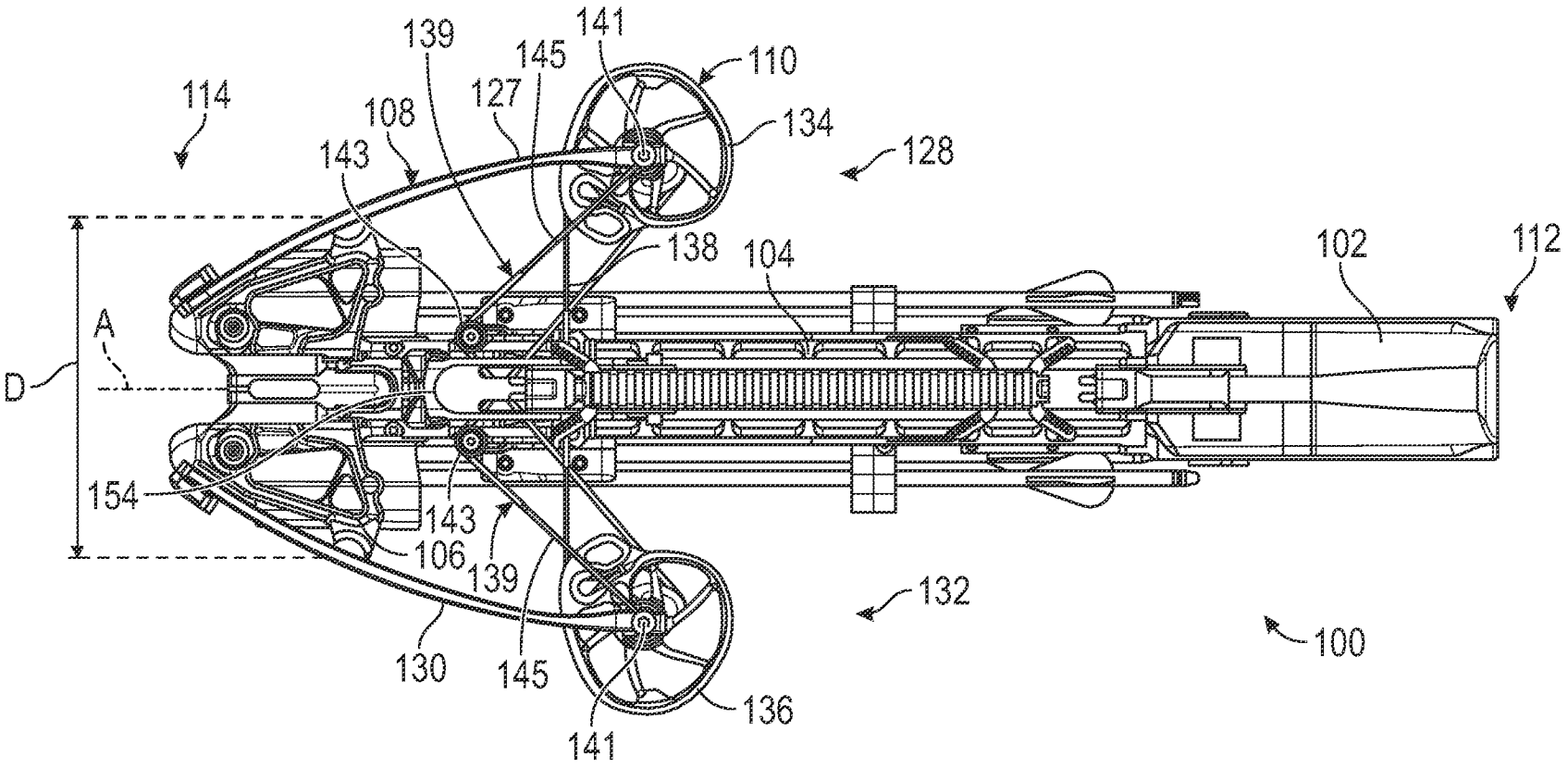
FIG. 2 is a top view of the crossbow of FIG. 1.
Figure 4:
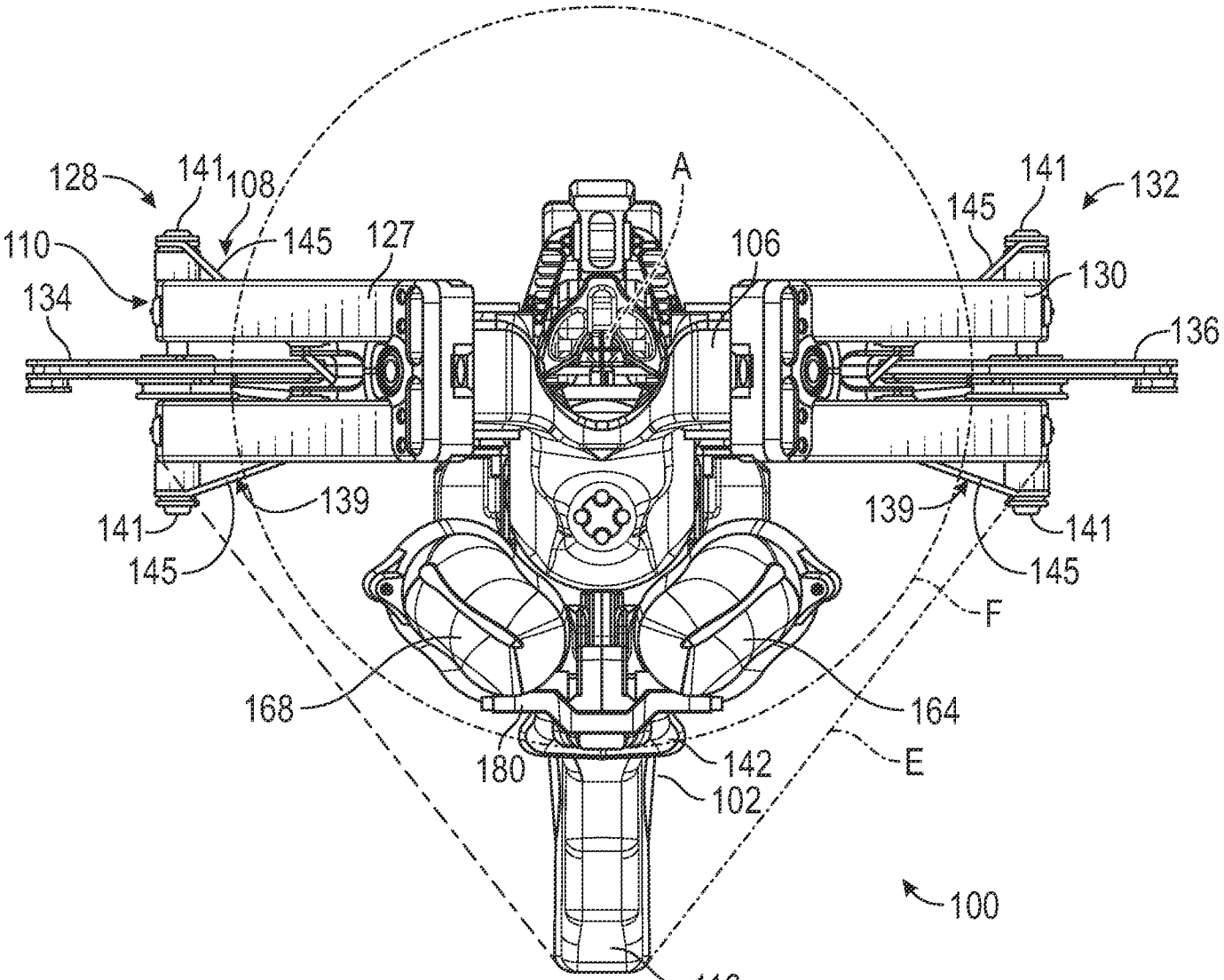
FIG. 4 is a front view of the crossbow of FIG. 1.

The crossbow 100 defines an envelope. The envelope is defined as a bounded volume occupied by the crossbow 100. As shown in FIG. 2, in some embodiments, the envelope is defined at least in part by a riser width D of the riser 106 perpendicular to the projectile axis A. The riser width D is the maximum width of the riser 106 perpendicular to the projectile axis A. As shown in FIG. 4, in some embodiments, the envelope is defined at least in part by a bounded area E bounded by planes intersecting both the grip 116 and the limb assemblies 108. In some embodiments, the envelope is defined at least in part by a cylindrical volume F extending parallel to the projectile axis A and defining a radius. In some embodiments, the radius of the cylindrical volume F is about ten inches. In some embodiments, the radius of the cylindrical volume F is between about three inches and about fifteen inches. In some embodiments, the radius is less than or equal to the riser width D.

Figure 5:
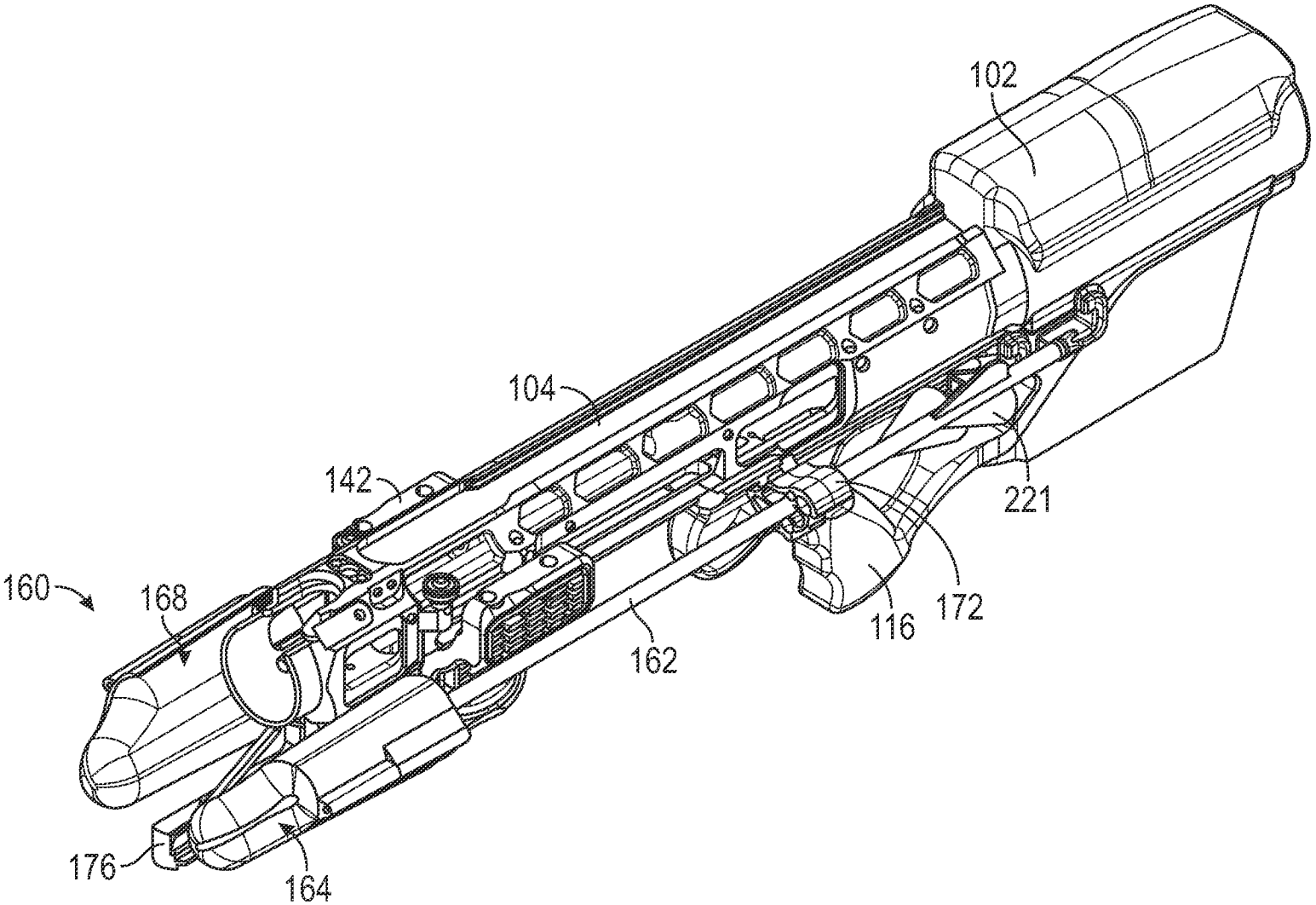
FIG. 5 is a perspective view of a barrel rail, a stock, a pump mechanism, and a quiver assembly of the crossbow of FIG. 1, according to some embodiments.
Figure 6:
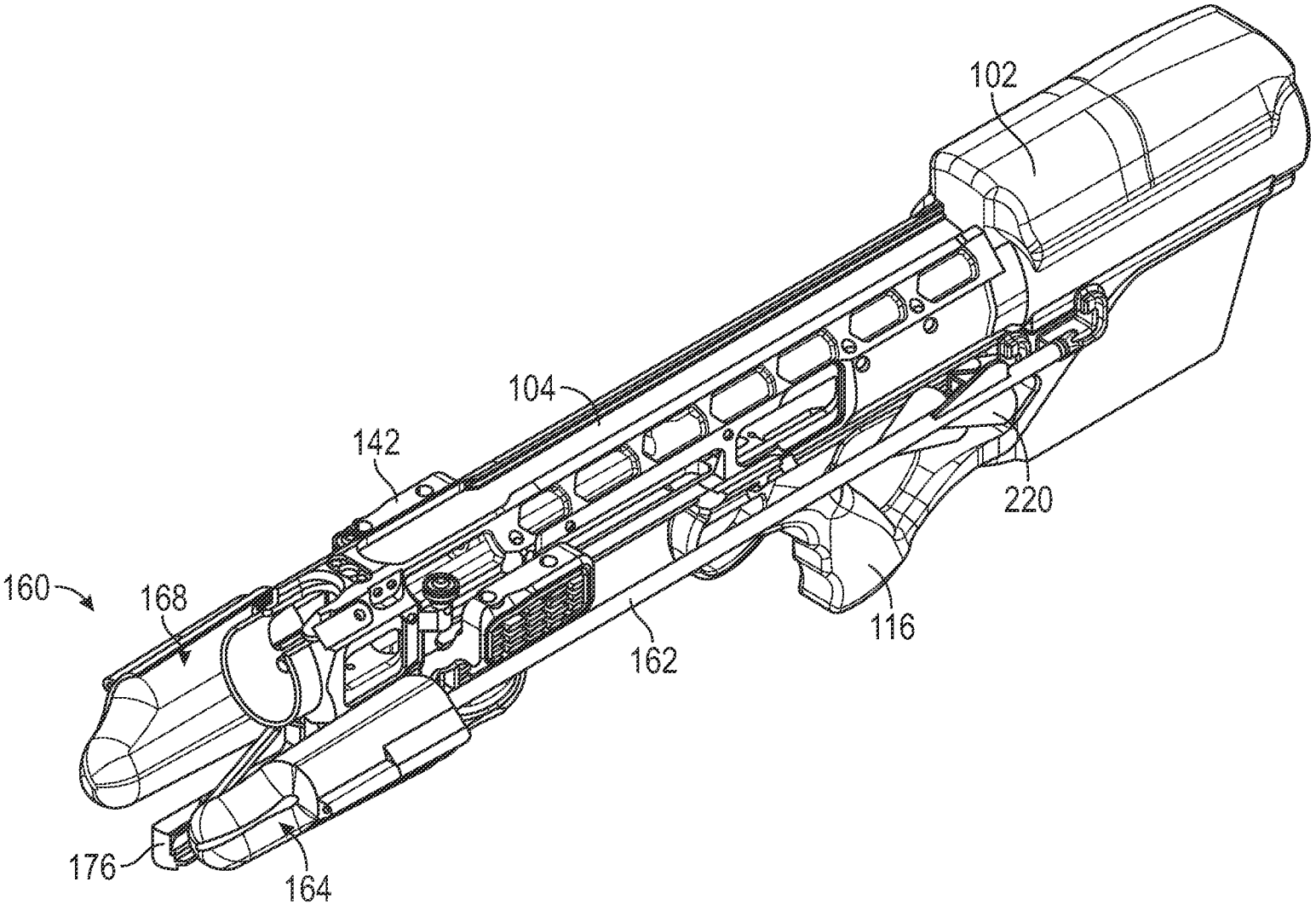
FIG. 6 is a perspective view of a barrel rail, a stock, a pump mechanism, and a quiver assembly with no nock-end holder of the crossbow of FIG. 1, according to some embodiments.
Figure 7:
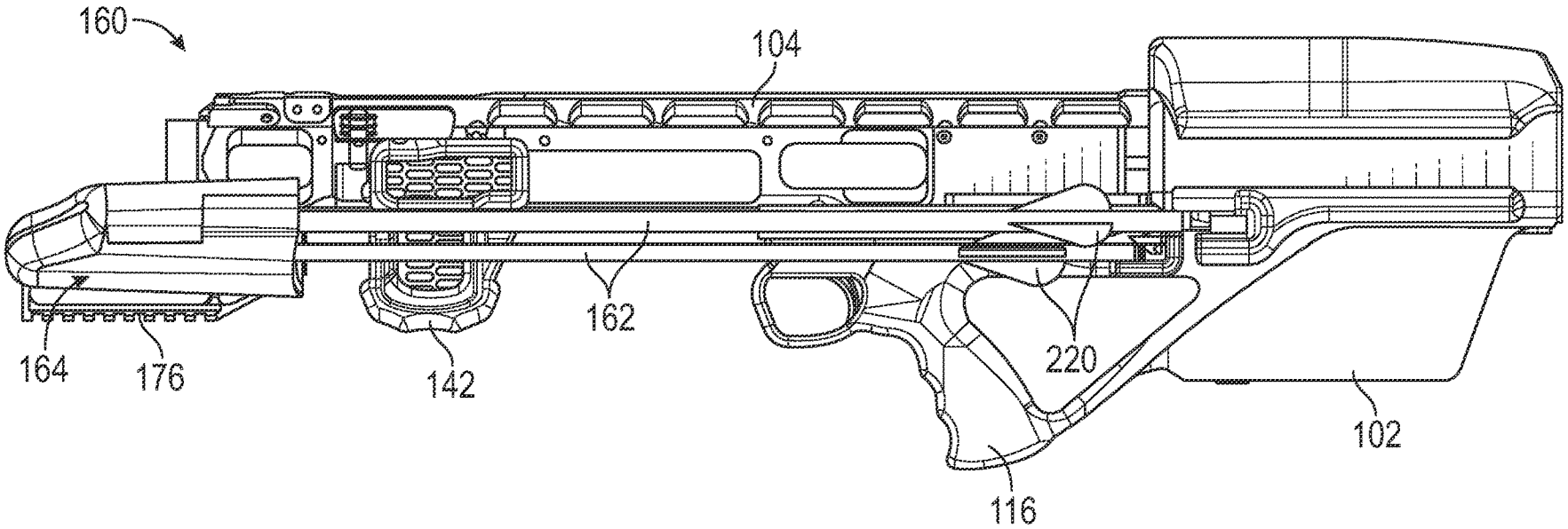
FIG. 7 is a left side view of the barrel rail, the stock, the pump mechanism, and the quiver assembly with no nock-end holder of the crossbow of FIG. 6.

As shown in FIG. 5, the crossbow 100 includes a compact quiver assembly 160 structured to hold projectiles in the form of arrows 162 within the envelope of the crossbow 100. The compact quiver assembly 160 includes a left magazine 164 and a right magazine 168. In some embodiments, the right magazine 168 is a mirror image of the left magazine 164. In some embodiments, the left magazine 164 or the right magazine 168 are eliminated. The compact quiver assembly 160 also includes a left nock-end grabber 172 that supports a nock-end of the arrows 162. In some embodiments, the compact quiver assembly 160 is connected to the barrel rail 104. In some embodiments, the compact quiver assembly 160 is connected to a lower mounting rail in the form of a lower Picatinny rail 176 that is connected to the barrel rail 104. In some embodiments, the compact quiver assembly 160 is held in place with a press fit engagement, a latch, a Picatinny mount, a snap, a hook and loop fastener, a fastener (e.g., a screw), or a another structure. FIGS. 6 and 7 show the compact quiver assembly 160 with the nock-end grabber 172 eliminated.

Figure 8:
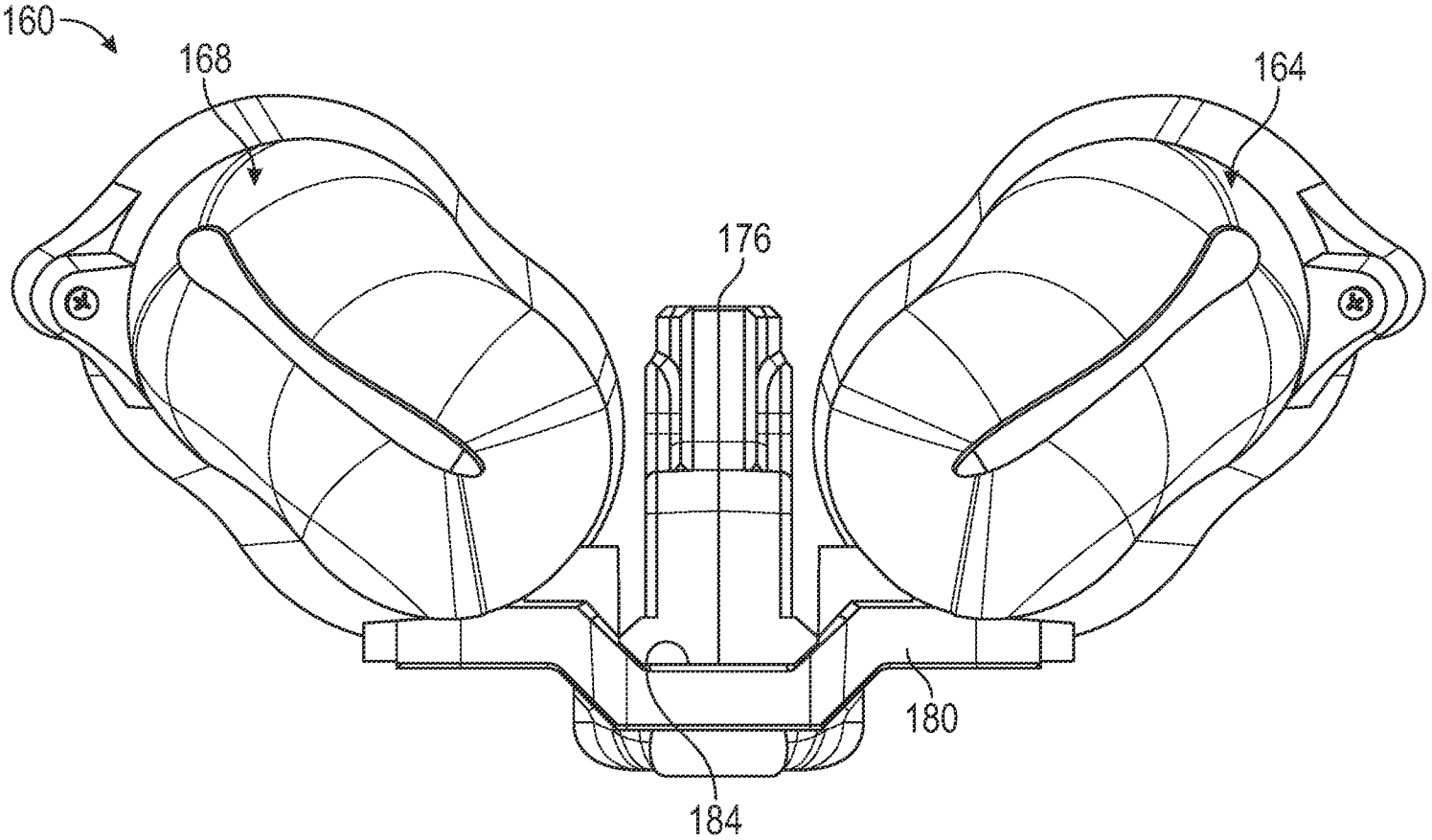
FIG. 8 is a front view of the quiver assembly and a lower mounting rail, according to some embodiments.

As shown in FIG. 8, the compact quiver assembly 160 includes a mount 180 that connects the left magazine 164 and the right magazine 168 into a single unit. In some embodiments, the left magazine 164 and the right magazine 168 are each removably coupled to the mount 180. In some embodiments, the left magazine 164 and the right magazine 168 are non-removably coupled to the mount 180 so that the left magazine 164, the right magazine 168, and the mount 180 form a unitary structure. The mount 180 includes an attachment structure in the form of a Picatinny clamp 184 that connects to the Picatinny rail 176. The Picatinny clamp 184 can provide a quick connect feature to allow the user to quickly mount and remove the compact quiver assembly 160 from the crossbow 100. In some embodiments, the mount 180 includes a different connection style or mechanism that allows for quick connection and disconnection form the crossbow 100. In some embodiments, the mount 180 is structured to connect to other mounts that can be installed in or on a tree, a stand, a vehicle, or another object other than the crossbow 100. This can allow for convenient storage of arrows 162 within the compact quiver assembly 160 remote from the crossbow 100.

Figure 9:
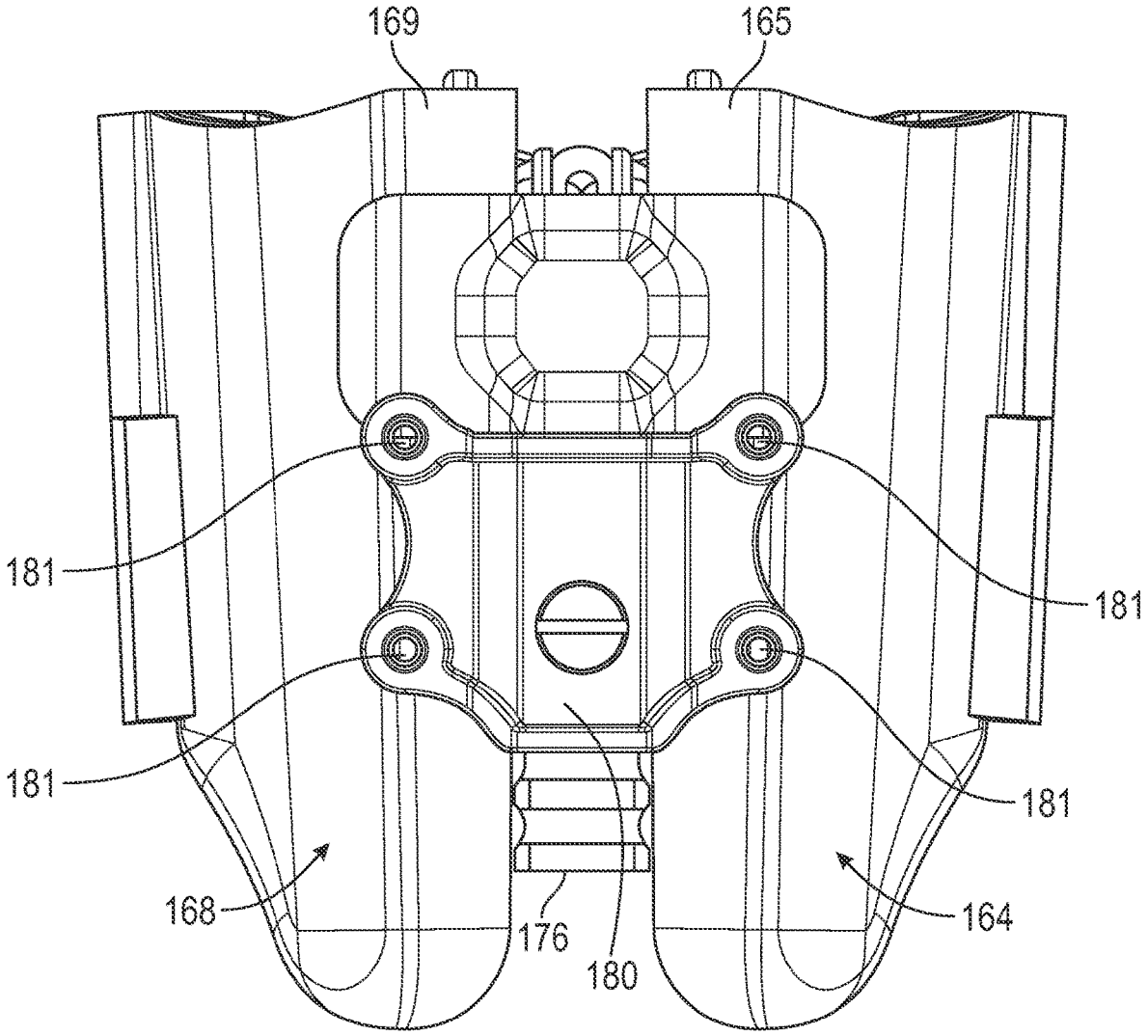
FIG. 9 is a bottom view of the quiver assembly and a mount, according to some embodiments.

As shown in FIG. 9, the mount includes at least one mounting aperture 181. The mounting aperture 181 is configured to receive a fastener (e.g., a screw, a bolt, a rivet, or some other fastener) to couple the mount 180 to the left magazine 164 and/or the right magazine 168. The mount 180 can couple to a bottom surface 165 of the left magazine 164 and a bottom surface 169 of the right magazine 168. For example, the mount 180 can extend over at least a portion of the bottom surface 165 of the left magazine 164 and the bottom surface 169 of the right magazine 168 such that a fastener (not shown) can be inserted into the mounting apertures 181 of the mount 180 to secure the mount to the bottom surface 165 of the left magazine 164 and to the bottom surface 169 of the right magazine 168. The mounting apertures 181 are positioned on the mount 180 in a generally linear arrangement (e.g., substantially parallel to the projectile axis A). In other embodiments, the mounting apertures 181 can be positioned on the mount 180 in some other fashion, such as a non-linear arrangement or some other arrangement. For example, the mount 180 can include multiple mounting apertures 181 to allow a user to mount the left magazine 164 or the right magazine 168 to the mount in a variety of different configurations, such as angled relative to the projectile axis A, angled vertically downwards, angled vertically upwards, or some other configuration. In this way, the mount 180 can provide for flexible coupling of the left magazine 164 and/or the right magazine 168 to a variety of bows (e.g., crossbows, vertical bows, or other projectile launchers) according to a user's preference.

Figure 10:
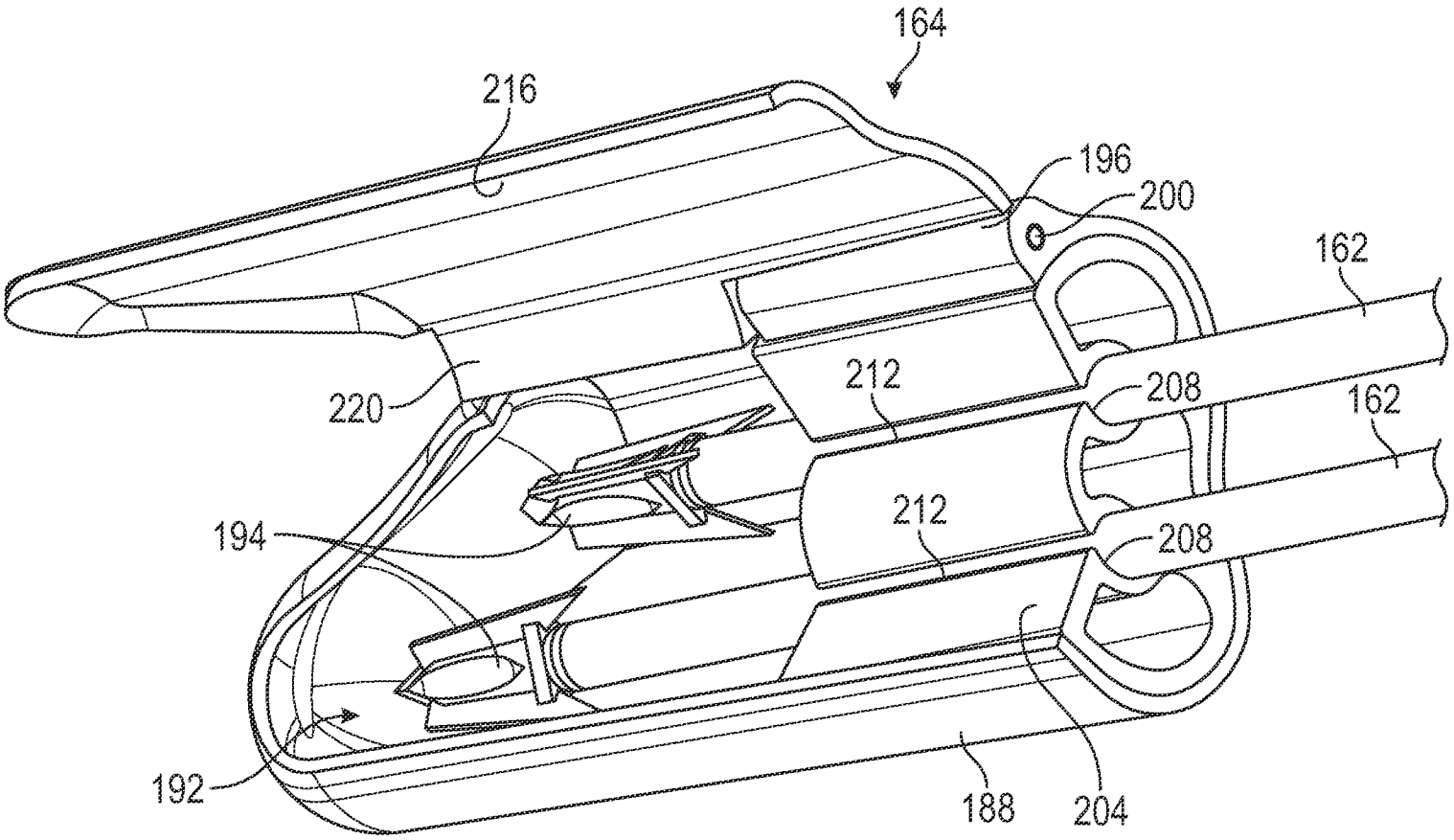
FIG. 10 is a left, rear, bottom perspective view of a magazine of the quiver assembly arranged in an open position, according to some embodiments.

As discussed above, the left magazine 164 and the right magazine 168 are substantially similar. As shown in FIG. 10, the left magazine 164 includes a hood 188 defining an interior cavity 192 sized to surround broadheads 194 of the arrows 162, and a hood hinge 196 sized to receive a hinge pin 200. A grabber 204 is received within the hood 188 and includes grabber openings 208 open at slots 212. The user can insert an arrow 162 into the grabber opening 208 via the slot 212 to secure the arrow 162 within the grabber 204. In some embodiments, the grabber 204 is adhered within the hood 188. In some embodiments, the grabber 204 is co-molded with the hood 188 such as in a two-shot injection mold. In some embodiments, the hood 188 is formed of a plastic such as a generally rigid plastic. In some embodiments, the grabber 204 is formed of a rubber material to protect the arrows 162 and reduce noise from arrow 162 rattling.

The left magazine 164 also includes a cover 216 including a cover hinge 220 sized to receive the hinge pin 200. The cover 216 is hingedly connected to the hood 188 via the hinge pin 200. The cover 216 is movable between a closed position which inhibits access the interior cavity 192 (e.g., inhibits removal of the arrows 162 from the grabber 204), and an open position (shown in FIG. 10) that allows access to the interior cavity 192 and therefore provides easy access to load and remove arrows 162 from the grabber 204. In some embodiments, the cover 216 is maintained in the closed position relative to the hood 188 via a slight interference fit. In some embodiments, the cover 216 is maintained in the closed position relative to the hood 188 via a latch, a button, or another closure mechanism. In some embodiments, a spring is arranged to bias the cover 216 toward the open position. In some embodiments, the spring is arranged within the hinge structure.

Figure 11:
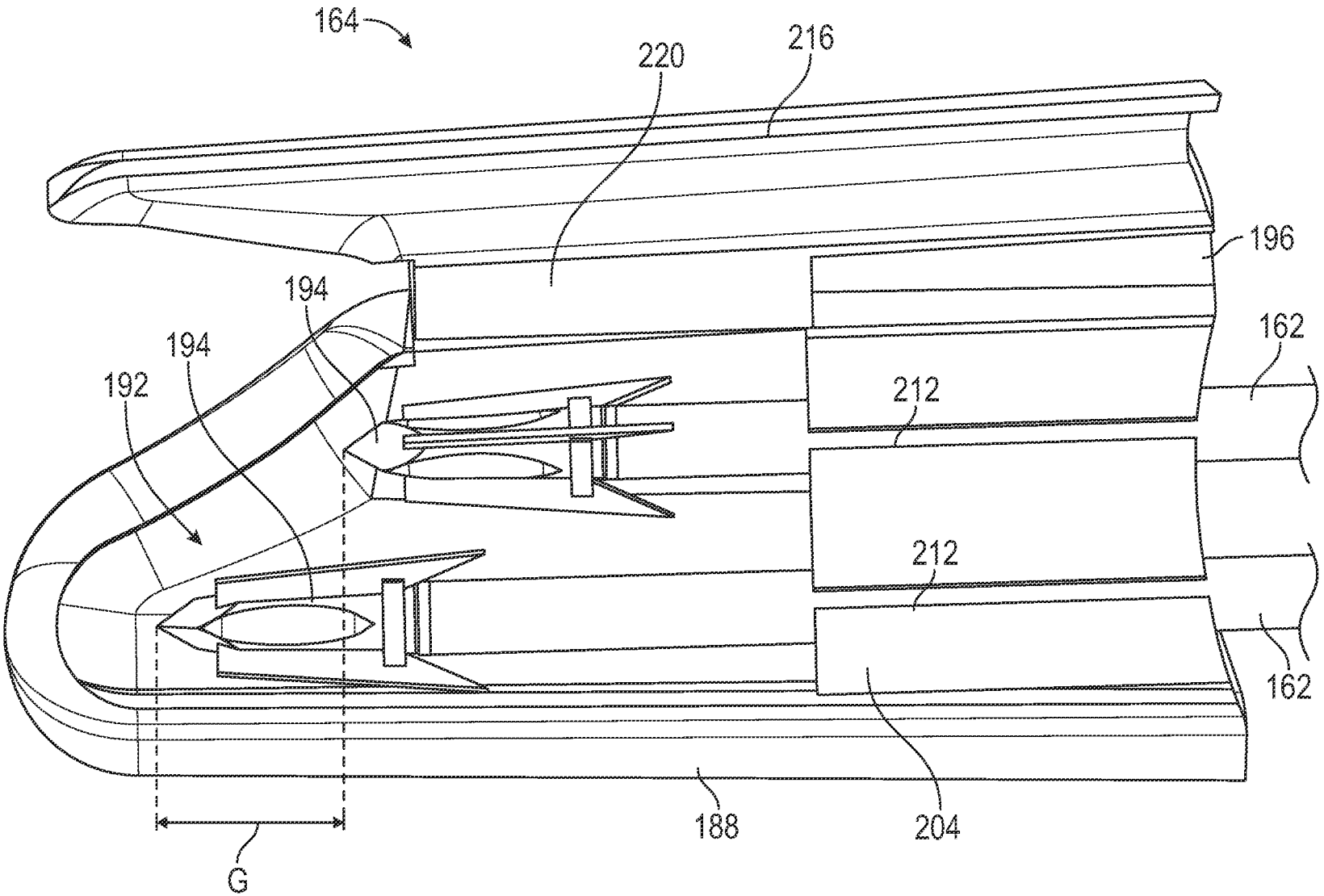
FIG. 11 is a left, bottom perspective view of the magazine of the quiver assembly of FIG. 9.

As shown in FIG. 11, the hood 188 is shaped to provide an offset G between positions of the arrows 162. In some embodiments, the offset G is sized to accommodate a variety of arrow tips, such as broadheads 194 or other arrowheads that can used with the crossbow 100. Specifically, the offset G is sized to accommodate broadheads 194 that can include one or more blades or other elements extending outwardly in a partially radial direction from an end of the arrow 162. For example, the offset G inhibits contact between two adjacent broadheads 194 that are both loaded into the left magazine 164. In some embodiments, the offset G is sized to inhibit contact between fletchings 221 (see FIG. 7) or some other feature.

Figure 12:
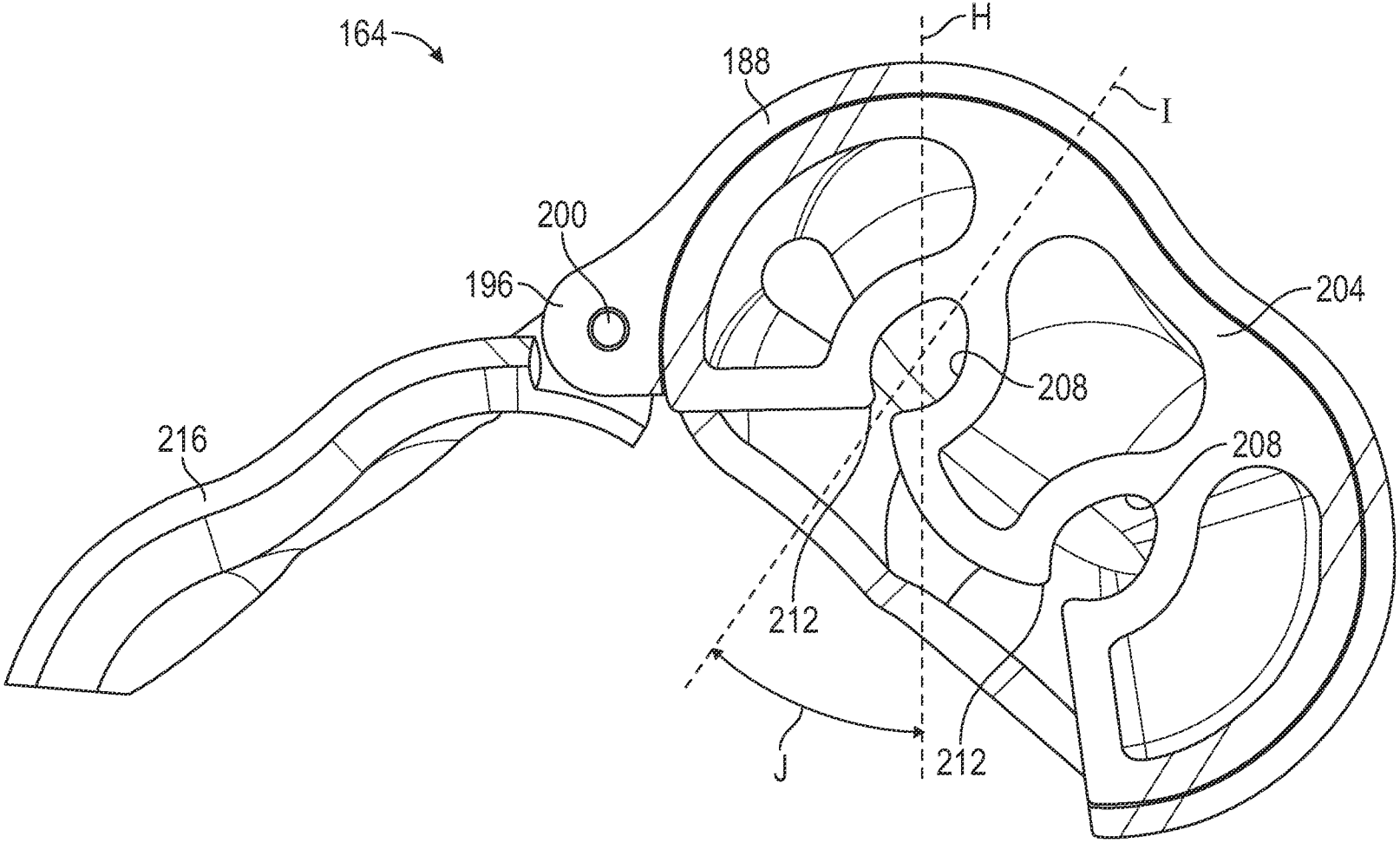
FIG. 12 is a rear view of the magazine of the quiver assembly of FIG. 9.

As shown in FIG. 12, the left magazine 164 is mounted to the crossbow 100 oblique relative to a vertical plane H defined parallel to the projectile axis A. The grabber 204 is positioned relative to the crossbow 100 so that the grabber openings 208 are aligned along a grabber plane I defined by the slot 212 and the opening 208 along the path an arrow 162 is inserted into the opening 208. In some embodiments, the grabber plane I is oblique to the vertical plane H by an angle J. In some embodiments, the angle J is about thirty degrees (30°). In some embodiments, the angle J is between about fifteen degrees (15°) and about forty-five degrees (45°). Arranging the openings 208 at the angle J makes it easier for the user to insert and remove the arrows 162 without interfering with the remaining portions of the crossbow 100.

Figure 13:
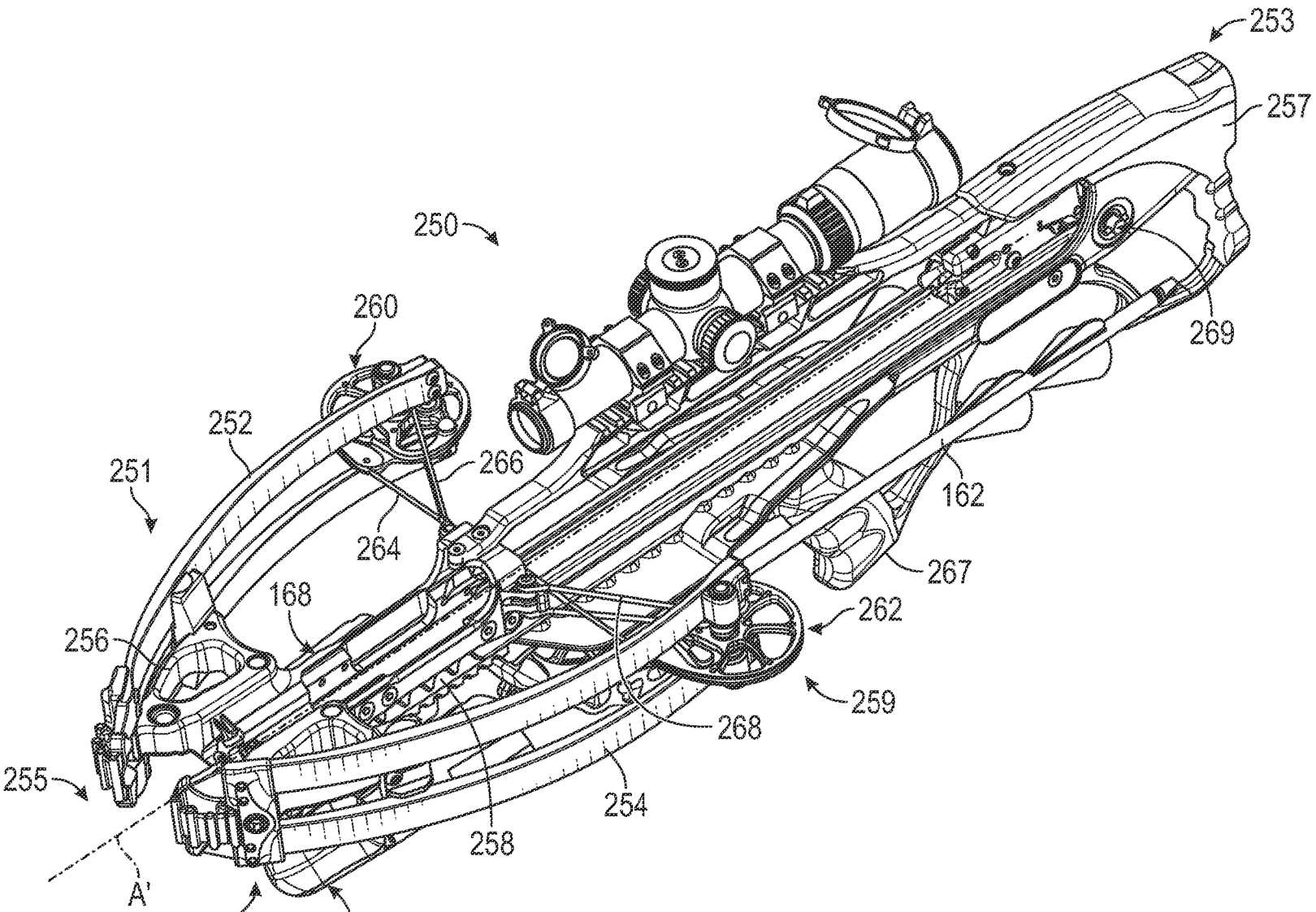
FIG. 13 is a perspective view of another crossbow, according to some embodiments.
Figure 14:
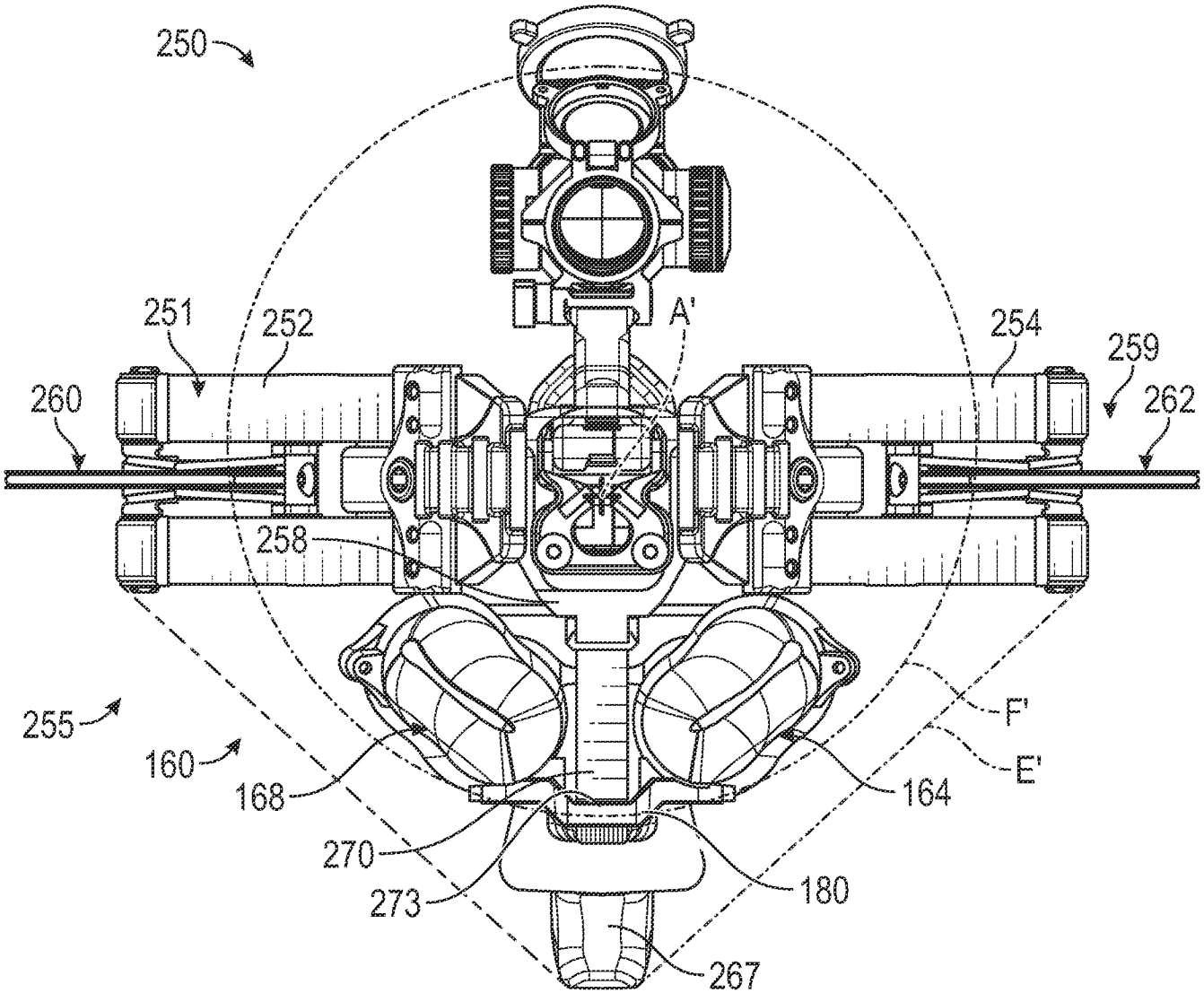
FIG. 14 is a front view of the crossbow of FIG. 13.
Figure 15:
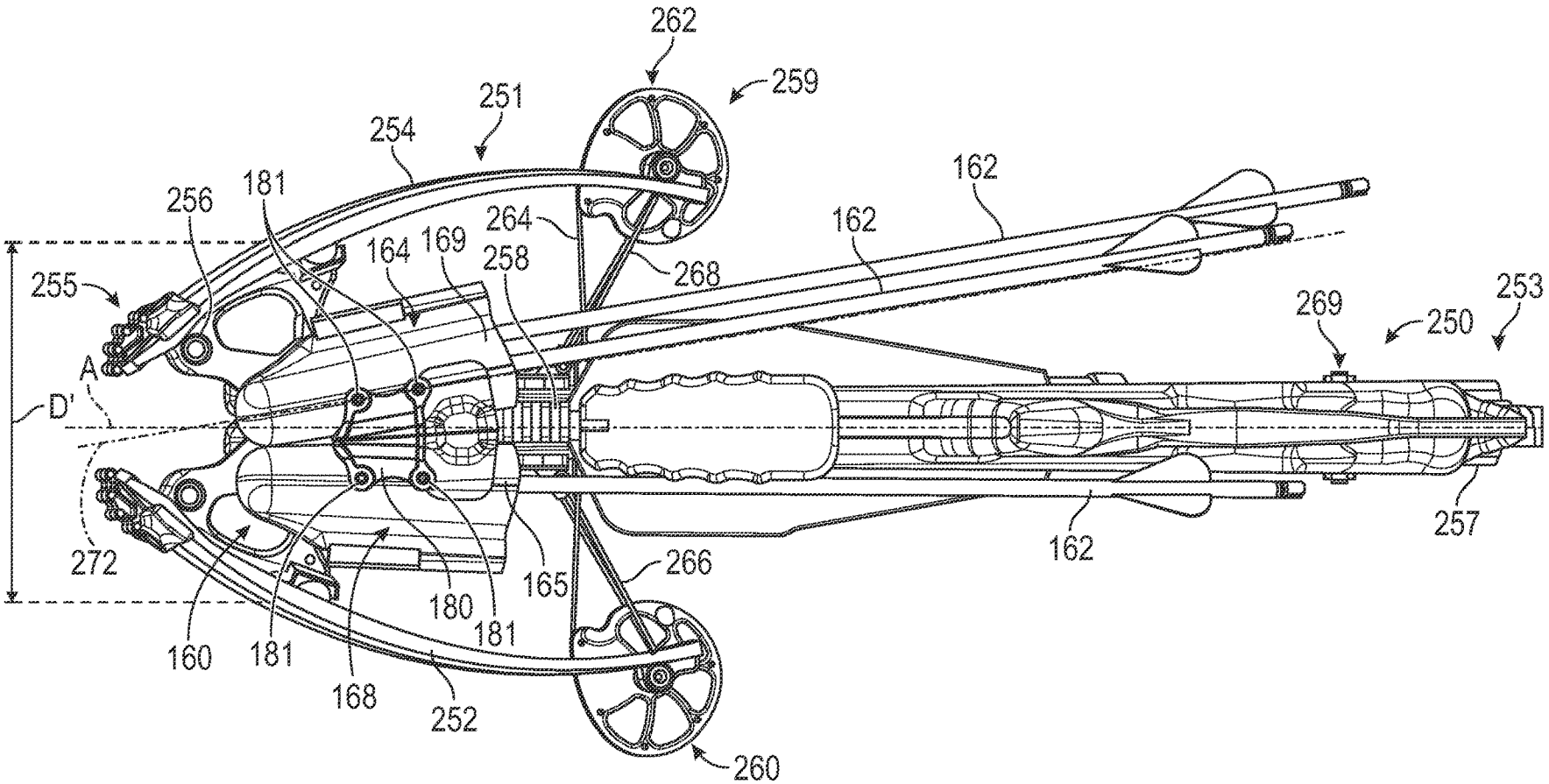
FIG. 15 is a bottom view of the crossbow of FIG. 13.

As shown in FIGS. 13-15, a crossbow 250 includes a stock 257, a center rail 258, a riser 256, a limb assembly 251, a cam assembly 259, a grip 267, and a cocking mechanism 269. The center rail 258 is coupled between the stock 257 and the riser 256, with the stock 257 being arranged at a first or rear end 253 of the center rail 258 and the riser 256 being arranged at a second or front end 255 of the center rail 258. The center rail 258 defines a projectile axis A' along which a projectile (not shown) can be arranged and fired. The riser 256 is coupled to the limb assembly 251 so that the limb assembly 251 can flex relative to the riser 256. For example, the limb assembly 251 includes a plurality of flexible limbs that each extend from the riser 256, in a direction back toward the rear end 253, to a free end. The free ends of the flexible limbs enable the flexible limbs to flex relative to the riser 256 and generate a firing force that is applied to a projectile as the crossbow 250 is fired. In some embodiments, the limb assembly 251 includes a first limb assembly 252 coupled to a first lateral side (e.g., a right side) of the riser 256 and a second limb assembly 254 coupled to a second lateral side (e.g., a left side) of the riser 256. In the illustrated embodiment, the first limb assembly 252 and the second limb assembly 254 both include two flexible limbs. In some embodiments, the first limb assembly 252 and the second limb assembly 254 both include more or less than two flexible limbs (e.g., one flexible limb, three flexible limbs, etc.).

The cam assembly 259 includes a first cam 260 (e.g., a right cam) and a second cam 262 (e.g., a left cam). The first cam 260 is rotatably coupled to the free ends of the flexible limbs in the first limb assembly 252, and the second cam 262 is rotatably coupled to the free ends of the flexible limbs in the second limb assembly 254. The cam assembly 259 is coupled to a drawstring 264 that is configured to move between an undrawn position (see, e.g., FIGS. 13 and 15) and a drawn position where the drawstring 264 is displaced along the projectile axis A' toward the stock 257 (i.e., toward the rear end 253 of the center rail 258). The cam assembly 259 is further coupled to one or more power cables 266. A first power cable 266 or a first plurality of power cables 266 (e.g., two power cables 266) engages with the first cam 260. A second power cable 268 or a second plurality of power cables 266 (e.g., two power cables 268) engages with the second cam 262. The drawstring 264 is moved from the undrawn position to the drawn position via the cocking mechanism 269, shown as a crank mechanism.

More particularly, the crossbow 250 includes two first power cables 266, including an upper power cable 266 and a lower power cable 266. The upper power cable 266 and the lower power cable 266 each engage with a power cable groove, journal, pulley, or other portion of the first cam 260. The upper power cable 266 and the lower power cable 266 are respectively routed from the first cam 260 (e.g., from a mounting post on the first cam 260) to the center rail 258. In other embodiments, the upper power cable 266 and the lower power cable 266 are coupled to the riser 256 or some other portion of the crossbow 250 (e.g., the flexible limbs of the second limb assembly 254). Because the upper power cable 266 and the lower power cable 266 are routed from the first cam 260 to the center rail 258, the upper power cable 266 and the lower power cable 266 do not cross over the projectile axis A'. The crossbow 250 includes two second power cables 268, including an upper power cable 268 and a lower power cable 268. The upper power cable 268 and the lower power cable 268 each engage with a power cable groove, journal, pulley, or other portion of the second cam 262. The upper power cable 268 and the lower power cable 268 are respectively routed from the second cam 262 (e.g., from a mounting post on the second cam 262) to the center rail 258. In other embodiments, the upper power cable 268 and the lower power cable 268 are coupled to the riser 256 or some other portion of the crossbow 250 (e.g., the flexible limbs of the first limb assembly 252). Because the upper power cable 268 and the lower power cable 268 are routed from the second cam 262 to the center rail 258, the upper power cable 268 and the lower power cable 268 do not cross over the projectile axis A'.

As the drawstring 264 is displaced from the undrawn position to the drawn position, the first cam 260 and the second cam 262 rotate relative to the free ends of the flexible limbs, and the flexible limbs flex relative to the riser 256. As the first cam 260 and the second cam 262 rotate, the first power cables 266 and the second power cables 268 are respectively wound on the first cam 260 and the second cam 262 (e.g., via the power cable journal or similar feature). The flexing of the flexible limbs loads the flexible limbs and generates a firing force on the drawstring 264. Once the drawstring 264 is in the drawn position, the user may selectively compress a trigger or other firing mechanism of the crossbow 250 to release the drawstring 264 and unload the flexible limbs. The drawstring 264 then travels back to the undrawn position and the unloading of the flexible limbs transfers the firing force to a projectile nocked to the drawstring 264 and fires the projectile along the projectile axis A' and outwardly from the front end 255 of the center rail 258.

The crossbow 250 can include the compact quiver assembly 160, including the left magazine 164 and the right magazine 168. The left magazine 164 and the right magazine 168 are coupled to the center rail 258 or the riser 256 of the crossbow 250 via the mount 180. As shown in FIG. 14, the mount 180 that connects the left magazine 164 and the right magazine 168 into a single unit and connects the compact quiver assembly 160 to the crossbow 250. In particular, the mount 180 can include a mounting block 270 that extends from the upwards from an upper surface 273 of the mount to the center rail 258 or riser 256 of the crossbow 250. The mounting block 270 can include a length sufficient to position the compact quiver assembly 160 away from the center rail 258, the riser 256, the limb assembly 251, and the cam assembly 259 of the crossbow 250 to avoid interference therewith. The mounting block 270 can be coupled to the mount 180 or can be integrally formed with the mount 180.

The crossbow 250 defines an envelope. The envelope is defined as a bounded volume occupied by the crossbow 250. As shown in FIG. 2, in some embodiments, the envelope is defined at least in part by a riser width D' of the riser 256 perpendicular to the projectile axis A'. The riser width D' is the maximum width of the riser 256 perpendicular to the projectile axis A'. As shown in FIG. 4, in some embodiments, the envelope is defined at least in part by a bounded area E' bounded by planes intersecting both the grip 267 and the limb assembly 251. In some embodiments, the envelope is defined at least in part by a cylindrical volume F' extending parallel to the projectile axis A' and defining a radius. In some embodiments, the radius of the cylindrical volume F' is about ten inches. In some embodiments, the radius of the cylindrical volume F' is between about three inches and about fifteen inches. In some embodiments, the radius is less than or equal to the riser width D'. The mounting block 270 spaces the compact quiver assembly 160 away from the center rail 258 but within the cylindrical volume F', according to one embodiment.

As depicted in FIG. 15, the compact quiver assembly 160 can include one or more of the left magazine 164 or the right magazine 168 oriented at an angle relative to the projectile axis A'. For example, the mount 180 can include the mounting apertures 181 configured to couple to the bottom surface 165 of the left magazine 164 and/or the bottom surface 169 of the right magazine 168 with the right magazine 168 and any arrows 162 received within the right magazine 168 oriented substantially along an axis 272. The axis 272 is non-parallel with the projectile axis A' such that the arrows 162 received within and extending from the right magazine 168 extend at an angle relative to the projectile axis A'. In such embodiments, the right magazine 168 can itself be positioned within the envelope of the crossbow 250, namely within the bounded area E' and within the cylindrical volume F', while any arrows 162 received within the right magazine 168 can extend beyond (e.g., outside of) the cylindrical volume F' and away from the center rail 258. In some embodiments, the left magazine 164 could be angled relative to the projectile axis A' in a similar fashion, but at an opposite angle (e.g., angled away from the center rail 258 in an opposite direction).

Figure 16:
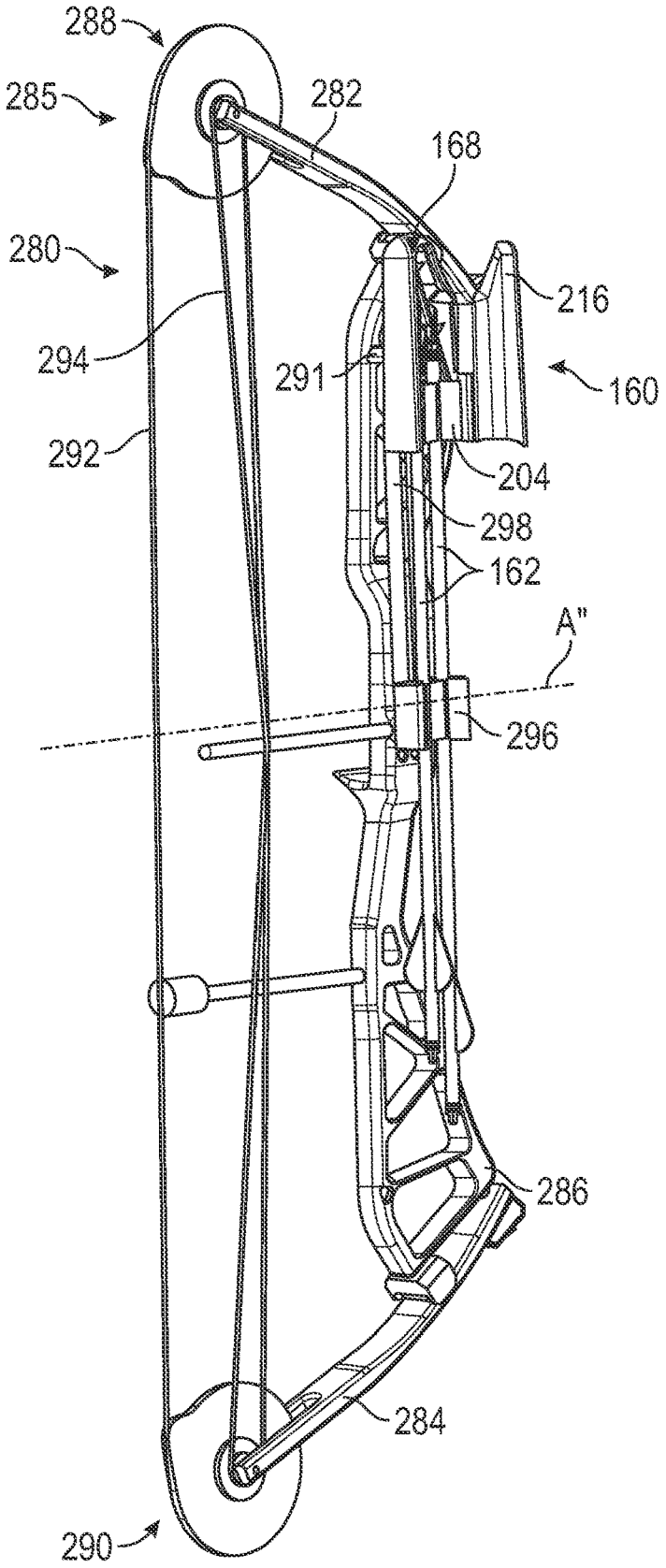
FIG. 16 is a perspective view of a vertical bow, according to some embodiments.

As shown in FIG. 16, the compact quiver assembly 160 can be coupled to a bow 280, shown as a vertical bow. The vertical bow 280 includes a first flexible limb 282 and a second flexible limb 284, each coupled to a riser 286. The vertical bow 280 includes a cam assembly 285 having a first cam 288 and a second cam 290, each coupled to a free end of the first flexible limb 282 and the second flexible limb 284, respectively. A bowstring 292 engages with each of the first cam 288 and the second cam 290. The vertical bow further includes one or more power cables 294 that engage with one or more of the first cam 288, the second cam 290, the first flexible limb 282, and the second flexible limb 284. The bowstring 292 is configured to move from an undrawn position to a drawn position. As the bowstring 292 is displaced from the undrawn position to the drawn position, the first cam 288 and the second cam 290 rotate relative to the free ends of the flexible limbs 282, 284, and the flexible limbs 282, 284 flex relative to the riser 286. As the first cam 288 and the second cam 290 rotate, the power cable 294 is wound on the first cam 288 and/or the second cam 290 (e.g., via the power cable journal or similar feature). The flexing of the flexible limbs 282, 284 loads the flexible limbs 282, 284 and generates a firing force on the bowstring 292. Once the bowstring 292 is in the drawn position, the user may release the bowstring 292 and unload the flexible limbs 282, 284. The bowstring 292 then travels back to the undrawn position and the unloading of the flexible limbs 282, 284 transfers the firing force to a projectile nocked to the bowstring 292, and fires the projectile from the bow 280 along a projectile axis A".

The bow 280 includes the compact quiver assembly 160, or a portion thereof. Specifically, the bow 280 includes a single magazine, shown as the right magazine 168 coupled to the riser 286. The right magazine 168 is coupled to the riser 286 of the bow 280 via a mount 291. The mount 291 can be a post, block, or protrusion extending from the riser 286. In some embodiments, the mount 291 includes an aperture configured to receive a fastener (e.g., a screw or bolt) that is further received in the right magazine 168 to couple the magazine 168 to the mount 291. The aperture of the mount 291 can be defined through an entirety of the mount 291 and the riser 286 such that a fastener can extend through the riser 286, the mount 291, and at least a portion of the right magazine 168, for example. In some embodiments, the mount 291 can be or include a fastener that protrudes towards the right magazine 168 and is received in a corresponding aperture or opening of the right magazine 168 to couple the right magazine 168 to the mount 291. The mount 291 can be coupled to the riser 286 (e.g., be a separate component) or can be integrally formed with the riser 286. As shown in FIG. 16, the compact quiver assembly 160 of the bow 280 optionally includes at least one nock-end grabber 296 that supports a nock-end of the arrows 162. The nock-end grabber 296 can be substantially the same as the grabber 204 of the right magazine 168, or it can have a different structure, material, shape, etc. In various embodiments, the nock-end grabber 296 can secure a shaft of the arrows 162 received in the right magazine 168 to retain the arrow 162 tightly against the riser 286 of the bow 280. In some embodiments, the nock-end grabber 296 is coupled to the right magazine 168 via at least one linkage 298. The linkage 298 can be a rigid, elongated member extending from the mount 291 or from the right magazine 168 to which the nock-end grabber 296 is coupled. In other embodiments, the nock-end grabber 296 is coupled to the riser 286 and is not coupled to the right magazine 168. In some embodiments, the bow 280 can include multiple nock-end grabbers 296 configured to support the arrow 162 at various positions along the shaft of the arrow 162. In yet other embodiments, the compact quiver assembly 160 of the bow 280 does not include the nock-end grabber 296.

As utilized herein with respect to numerical ranges, the terms "approximately," "about," "substantially," and similar terms generally mean+/−10% of the disclosed values. When the terms "approximately," "about," "substantially," and similar terms are applied to a structural feature (e.g., to describe its shape, size, orientation, direction, etc.), these terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using one or more separate intervening members, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps or operations, the order of such steps may differ from what is depicted and described, unless specified differently above. Also, two or more steps may be performed concurrently or with partial concurrence, unless specified differently above.

It is important to note that the construction and arrangement of the compact quiver assembly as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A compact quiver assembly for a crossbow defining an envelope, comprising:

a hood defining an interior cavity;

a grabber received within the hood and structured to support a shaft of one or more arrows; and a cover moveable relative to the hood between an open position providing access to the grabber, and a closed position inhibiting access to the grabber, wherein the compact quiver assembly is positioned substantially within the envelope of the crossbow, and wherein the hood is coupled to the crossbow.

2. The compact quiver assembly of claim 1, wherein the hood provides an offset that is configured to inhibit contact between two adjacent broadheads within the interior cavity.

3. The compact quiver assembly of claim 1, wherein the hood is formed from a plastic material and the grabber is formed from an elastic material.

4. The compact quiver assembly of claim 1, wherein the crossbow defines a vertical plane, wherein the grabber includes an opening sized to receive and hold a shaft of an arrow of the one or more arrows, the opening defining a grabber plane along which the arrow is inserted and removed from the opening, the grabber contacting the shaft when the arrow is inserted in the opening, and wherein the grabber plane is arranged oblique to the vertical plane.

5. The compact quiver assembly of claim 4, wherein the grabber plane is arranged relative to the vertical plane by an angle between about fifteen degrees (15°) and about forty-five degrees (45°).

6. A compact quiver assembly for a bow defining an envelope, comprising:

a first magazine structured to hold one or more arrows;

a second magazine structured to hold one or more arrows, the second magazine spaced apart from the first magazine; and a mount coupled to both the first magazine and the second magazine, the mount defining a quick connection structured to engage the bow, wherein the compact quiver assembly is positioned substantially within the envelope of the bow.

7. The compact quiver assembly of claim 6, wherein each of the first magazine and the second magazine include:

a hood defining an interior cavity;

a grabber received within the hood and structured to hold one or more arrows; and a cover moveable relative to the hood between an open position providing access to the grabber, and a closed position inhibiting access to the grabber.

8. The compact quiver assembly of claim 7, wherein the bow defines a vertical plane, wherein each grabber includes an opening sized to receive and hold an arrow of the respective one or more arrows, the opening defining a grabber plane along which the arrow is inserted and removed from the opening, and wherein the grabber plane is arranged oblique to the vertical plane.

9. The compact quiver assembly of claim 8, wherein the grabber plane is arranged relative to the vertical plane by an angle between about fifteen degrees (15°) and about forty-five degrees (45°).

10. The compact quiver assembly of claim 7, wherein the hood provides an offset that is configured to inhibit contact between two adjacent broadheads within the interior cavity.

11. The compact quiver assembly of claim 7, wherein the cover is movably coupled to the hood via a hinge.

12. The compact quiver assembly of claim 6, wherein the mount defines one or more mounting apertures configured to receive one or more fasteners, the one or more fasteners to couple a bottom surface of the first magazine and a bottom surface of the second magazine to the mount.

13. A crossbow comprising:

a barrel rail defining a projectile axis;

a compact quiver assembly coupled to the barrel rail, the compact quiver assembly including:

a hood defining an interior cavity;

a grabber received within the hood and structured to hold one or more arrows; and a cover moveable relative to the hood between an open position providing access to the grabber, and a closed position inhibiting access to the grabber, wherein the crossbow defines an envelope, and wherein the compact quiver assembly is positioned wholly within the envelope of the crossbow.

14. The crossbow of claim 13, wherein the envelope is defined by a bounded volume occupied by the crossbow.

15. The crossbow of claim 13, further comprising a riser coupled to the barrel rail, the riser defining a maximum riser width in a direction perpendicular to the projectile axis, wherein the envelope is defined by the maximum riser width.

16. The crossbow of claim 13, wherein the envelope is defined by a cylindrical volume extending coaxially with the projectile axis and defining a radius between about three inches and about fifteen inches.

17. The crossbow of claim 13, wherein the crossbow defines a vertical plane, wherein the grabber includes an opening sized to receive and hold an arrow of the one or more arrows, the opening defining a grabber plane along which the arrow is inserted and removed from the opening, and wherein the grabber plane is arranged oblique to the vertical plane.

18. The crossbow of claim 17, wherein the grabber plane is arranged relative to the vertical plane by an angle between about fifteen degrees (15°) and about forty-five degrees (45°).

19. The crossbow of claim 13, wherein the hood provides an offset that is configured to inhibit contact between two adjacent broadheads within the interior cavity.

* * * * *